US005414748A

United States Patent [19]

Upadhya

[11] Patent Number: 5,414,748

[45] Date of Patent: May 9, 1995

[54] X-RAY TUBE ANODE TARGET

[75] Inventor: Kamleshwar Upadhya, Quartz Hill, Calif.

[73] Assignee: General Electric Company, Milwaukee, Wis.

[21] Appl. No.: 93,610

[22] Filed: Jul. 19, 1993

[51] Int. Cl.[6] ..... H01J 35/10

[52] U.S. Cl. ..... 378/144; 378/127; 378/143

[58] Field of Search ..... 378/142, 143, 144, 125, 378/127, 129, 141

[56] References Cited

U.S. PATENT DOCUMENTS

| | | | |
|---|---|---|---|
| 3,969,131 | 7/1976 | Fatzer et al. | 428/316 |
| 4,953,190 | 8/1990 | Kukoleck et al. | 378/129 |
| 5,159,619 | 10/1992 | Benz et al. | 378/143 |
| 5,222,116 | 6/1993 | Eloff et al. | 378/143 |

*Primary Examiner*—David P. Porta
*Assistant Examiner*—Don Wong
*Attorney, Agent, or Firm*—James J. Lichiello; John H. Pilarski

[57] ABSTRACT

An x-ray tube having a rotating anode structure which comprises a circular titantium, zirconium, molybdenum alloy target section bonded to a graphite disc. The target section is coated with hefnium carbide as a heat emissivity barrier. The thickness of the barrier is preferably in the range of 4.0–5.0 μm.

1 Claim, 1 Drawing Sheet

X-RAY TUBE ANODE TARGET

BACKGROUND OF THE INVENTION

This invention relates to an X-ray tube anode target and, more particularly, to a special coating on a rotating anode target for increased heat emissivity purposes.

Ordinarily an X-ray beam generating device referred to as an X-ray tube comprises dual electrodes of an electrical circuit in an evacuated chamber or tube. One of the electrodes is a thermionic emitter cathode which is positioned in the tube in spaced relationship to a target anode. Upon energization of the electrical circuit, the cathode is electrically heated to generate a stream or beam of electrons directed towards the target anode. The electron stream is appropriately focussed as a thin beam of very high velocity electrons striking the target anode surface. The anode surface ordinarily comprises a predetermined material, for example, a refractory metal so that the kinetic energy of the striking electrons against the target material is converted to electromagnetic waves of very high frequency, i.e. X-rays, which proceed from the target to be collimated and focussed for penetration into an object usually for internal examination purposes, for example, medical diagnostic procedures.

Well known primary refractory metals for the anode target surface area exposed to the impinging electron beam include tungsten (W), molybdenum (Mo), and their many alloys for improved X-ray generation. In addition, the high velocity beam of electrons impinging the target surface generates extremely high and localized temperatures in the target structure accompanied by high internal stresses leading to deterioration and breakdown of the target structure. As a consequence, it has become a practice to utilize a rotating anode target generally comprising a shaft supported disk-like structure, one side or face of which is exposed to the electron beam from the thermionic emitter cathode. By means of target rotation, the impinged region of the target is continuously changing to avoid localized heat concentration and stresses and to better distribute the heating effects through out the structure. Heating remains a major problem in X-ray anode target structures. In a high speed rotating target, heating must be kept within certain proscribed limits to control potentially destructive thermal stresses particularly in composite target structures, as well as to protect low friction high precision bearings which support the target.

A target body is chosen from a material with a high heat storage capacity because most of the heat transfer must take place through radiation from the target to the X-ray tube or envelope structure. For example, only about 1.0% of the energy of the impinging electron beam is converted to X-rays with the remainder appearing as heat which must be rapidly dissipated from the target essentially by means of heat radiation. Accordingly, significant technological efforts are expended towards improving heat dissipation from X-ray anode target surfaces.

One preferred material for a rotating disk-like anode target is graphite (C) which has a high heat storage capacity and which readily accepts bonding of a refractory metal cover or surface as the cathode electron beam impinging surface. It is further imperative that good heat dissipation be provided for the composite structure of a graphite body with a refractory metal surface. Rotation of targets for improved heat dissipation and radiation has progressed to target speeds exceeding 10,000 rpm with elevated temperatures of 1200° C. and above, conditions which exacerbate potential defect sites associated with the metal surface or graphite body.

OBJECTS OF THE INVENTION

Accordingly, it is a principal object of this invention to provide means on a rotating anode target structure in an X-ray tube to increase heat dissipation and radiation characteristics of the target structure.

It is another object of this invention to apply external heat dissipating means directly on the periphery of a rotating anode target structure in an X-ray tube.

It is a further object of this invention to provide a high emissivity metal carbide coating on a peripheral rim surface of a rotating anode target in an X-ray tube.

SUMMARY OF THE INVENTION

A rotating disk-like anode target for X-ray tubes comprises a graphite body with a refractory metal target surface thereon together with an exposed coating of a high emissivity compound such as hafnium carbide (HfC) on the peripheral rim of the target surface.

This invention will be better understood when taken in connection with the following drawing and description.

BRIEF DESCRIPTION OF THE DRAWING

Referring now to FIG. 1, a rotating anode target or target structure 10 comprises a thicker disc-like body 11 of a high heat storage material such as graphite, and a thinner concentric circular disc-like metal target section or face 12 which may be a separate disc bonded to graphite body 11 by means of a brazing process, for example. Metal target section 12 is illustrated with one side or face bonded to graphite body 11. The opposite or exposed face includes a tapered annular edge section which tapers radially towards graphite body 11 to define an annular bevelled edge 13 of target section 12 with a narrow peripheral axial surface or rim 14. Annular and tapered section 13 is coated with a metal layer 15 which is impinged by the electron beam from the cathode emitter and is referred to generally as the focal track of the anode structure 10. In one practice of this invention, layer 15 comprised a tungsten (W)-rhenium (Re) alloy.

Figure 1:
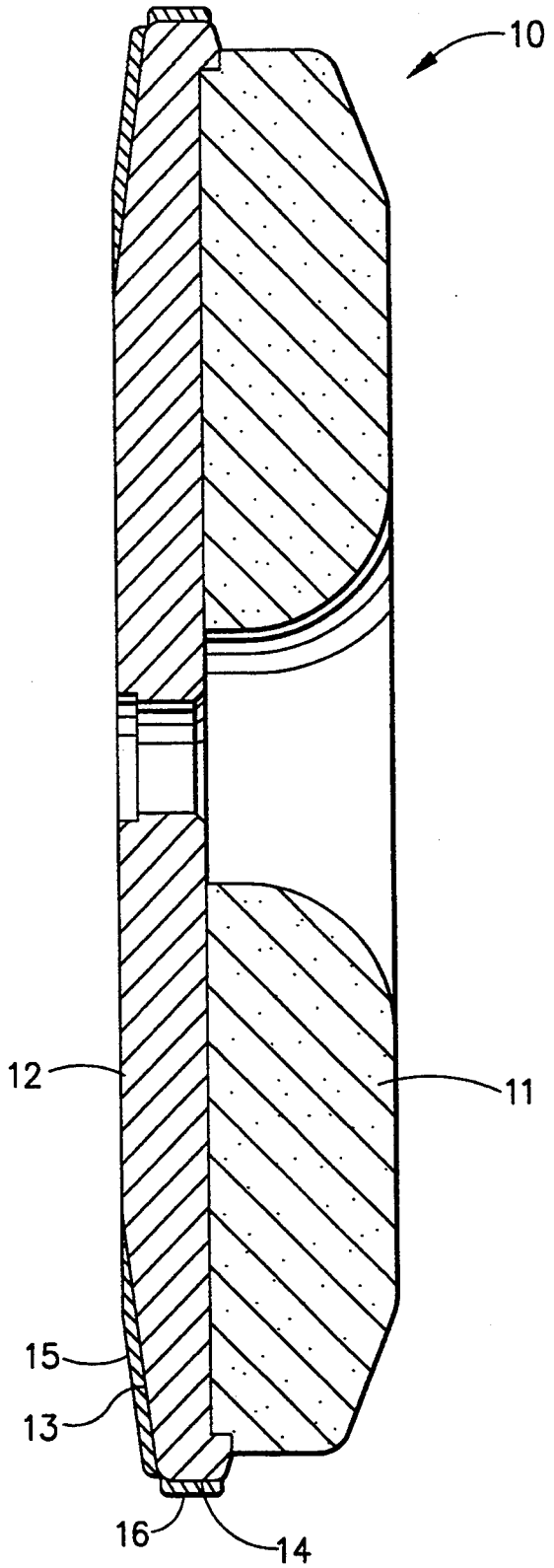
FIG. 1 is a side cross-sectional view of a rotating anode target structure with the high emissivity coating of the present invention on the rim of the metal target surface.

Target face section 12 usually includes a refractory metal such as tungsten or molybdenum or one of their many alloys. In the present invention target section 12 is referred to as TZM metal, an alloy comprising titanium, zirconium and molybdenum which has been found effective in resisting distortion during the thermal cycles produced by electron beam bombardment.

Graphite has a relatively high heat storage capacity but not a commensurate high thermal conductivity which is needed for rapid dissipation of heat from the bulk of the graphite body to its heat radiation surfaces. Operating temperatures of graphite body 11 may be from about 1100° C. to about 1400° C. Such elevated temperatures in combination with the high rotational speed of target 10 leads to the generation of severe stresses in target 10 with resultant potential target deterioration and structure failure. The additional heat dissipation means of the present invention is effective in reducing the noted operating temperatures.

For example, a high emissivity coating 16 is formed on rim 14 of face 12 and serves as an effective heat dissipation path or surface for heat to be radiated from structure 10. In order to be demonstrably effective, coating 16 is selected form those materials having heat emissivity values greater than the heat emissivity value of face 12 or focal track 15 of structure 10. One preferred coating material includes a metal compound of a metal from those of the transition metals of the Periodic Table of Elements particularly those of the titanium subgroup of the transition elements which include titanium (Ti), zirconium (Zr), and hafnium (Hf). A preferred metal is hafnium and a preferred compound of hafnium is hafnium carbide (HfC) which has a heat emissivity higher than that of TZM metal. HfC coating 16 is strategically located on rim surface 14 of target section 12 to extend coextensively around peripheral rim 14 to cover the fullest extent of the rim surface available although it is not necessary that coating 16 be in contact with either focal track 15 or graphite body 11. In this connection, the HfC coating 16 is an external additional and exposed metal coating on target structure 10. In one practice of this invention, a HfC coating 16 was formed on rim surface 14 by the well known sputter deposition process carried out under a pressure of from about 17.0 to about 18.00 μm Hg.

Other materials, including non-metals, having the above described heat emissivity characteristics may also be gainfully employed for coating 16.

For example, oxides of metals such as aluminum ($Al_2O_3$) utilized with an effective carbon barrier substrate may be employed as a coating 16. The high emissivity of a coating 16 such as a HfC coating accelerates heat transfer from the refractory metal face 12 to coating 16 for improved heat radiation. For example, temperature measurements indicate, that during operation of target structure 10 without a coating 16 a temperature of in excess of 1800° C. is present in the focal track area 15 of target face 12 and about 1478° C. at the braze interface between target face 12 and graphite body 11. However, during operation of target structure 10 with a hafnium carbide coating 16 thereon as illustrated in FIG. 1, temperature measurements indicated a temperature of about 1759° C. at the focal track area and about 1422° C. at the braze interface. Efficiency of heat radiation of the hafnium carbide coating is further increased by roughening the rim surface of the TZM metal so that the exposed surface of the thin HfC coating is correspondingly rough or textured. In one practice of this invention the base TZM surface was roughened by a sand blasting process prior to HfC coating and the final and exposed surface of the HfC coating may be described as a textured relief surface which generally corresponds to a sand blasted surface.

As one example in the practice of this invention, HfC coating 16 was deposited in its illustrated position by the well known sputter deposition process carried out at from about 17.0 to 18.0 μm Hg pressure to a thickness in the range of from about 4.0 to 5.0 μm. Other processes may also be gainfully employed such as chemical vapor deposition (CVD) or plasma assisted C.V.D. with appropriate masking to confine coating 16 to rim surface 14. Rim surface 14 is a substantially planar surface and the noted sandblasting preparation leaves surface 14 as well as coating 16 in an overall substantially planar state. The dark gray to black color of HfC coating 16 with minimum light reflectivity aids wheat dissipation.

This invention provides increased heat emissivity for rotating anode target structures, and particularly for such targets having a refractory metal target surface joined to a graphite body. The specific anode structure 10 as described provides an improved X-ray target which, because of its heat storage and dissipation characteristics, permit longer periods of operation before cooling is required.

While this invention has been disclosed and described with respect to preferred embodiments, it will be understood by those skilled in the art that various changes and modifications may be made without departing form the spirit and scope of the invention.

What is claimed:

1. An x-ray tube rotating anode structure comprising in combination (a) a circular graphite body, (b) a circular titanium, zirconium, molybdenum, alloy target section disc concentrically bonded to said graphite body, (c) said target section disc having a peripheral axial rim surface, (d) and an exposed high heat emissivity hafnium carbide coating on said target section rim surface, said coating having a heat emissivity greater than that of said target disc, (e) said coating being further characterized by having a thickness from about 4.0 μm to about 5.0 μm and a heat emissivity which increases with an increase in its temperature.

* * * * *